US006986671B2

(12) United States Patent
Margulis et al.

(10) Patent No.: US 6,986,671 B2
(45) Date of Patent: Jan. 17, 2006

(54) BOARD MOUNTED ELECTRICAL CONNECTOR ASSEMBLY

(75) Inventors: Yan Margulis, Buffalo Grove, IL (US); John S. Luthy, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/829,541

(22) Filed: Apr. 22, 2004

(65) Prior Publication Data

US 2005/0239317 A1 Oct. 27, 2005

(51) Int. Cl.
*H01R 12/00* (2006.01)

(52) U.S. Cl. ..... 439/78; 439/378; 439/554

(58) Field of Classification Search ..... 439/78, 439/82–83, 247, 378, 554, 557
See application file for complete search history.

(56) References Cited

U.S. PATENT DOCUMENTS

| | | | | |
|---|---|---|---|---|
| 5,169,322 | A * | 12/1992 | Frantz et al. | 439/82 |
| 5,340,319 | A | 8/1994 | Enomoto et al. | 439/75 |
| 5,629,839 | A | 5/1997 | Woychik | 361/803 |
| 5,634,810 | A | 6/1997 | Niitsu et al. | 439/378 |
| 6,004,140 | A | 12/1999 | Kato et al. | 439/65 |
| 6,176,738 | B1 * | 1/2001 | Consoli et al. | 439/545 |
| 6,315,606 | B1 | 11/2001 | Hwang | 439/557 |
| 6,358,075 | B1 | 3/2002 | Tischner | 439/248 |
| 6,592,401 | B1 | 7/2003 | Gardner et al. | 439/544 |

FOREIGN PATENT DOCUMENTS

EP 1 035 759 A2 9/2000

OTHER PUBLICATIONS

International Search Report, dated Jul. 8, 2005.

* cited by examiner

*Primary Examiner*—Michael C. Zarroli
(74) *Attorney, Agent, or Firm*—Stephen Z. Weiss

(57) ABSTRACT

An electrical connector is provided for mounting on a printed circuit board which includes a mounting surface, an opposite mating surface, a locating hole and a terminal-receiving aperture. The connector includes a dielectric housing having a front board-mounting face for mounting against the mounting surface of the printed circuit board. At least one terminal-receiving passage in the housing has a front opening in the front board-mounting face of the housing, with the front opening alignable with the terminal-receiving aperture in the printed circuit board. An alignment boss projects from the front board-mounting face of the housing and is insertable into the locating hole in the printed circuit board. The alignment boss has a guide hole for receiving a guide post from a complementary mating connector at the mating surface of the printed circuit board. A conductive terminal is mounted on the housing and includes a tail portion outside the housing for connection to an appropriate circuit trace on the printed circuit board. The terminal includes a contact portion inside the terminal-receiving passage of the housing for engaging an appropriate terminal of the complementary mating connector.

9 Claims, 4 Drawing Sheets

BOARD MOUNTED ELECTRICAL CONNECTOR ASSEMBLY

FIELD OF THE INVENTION

This invention generally relates to the art of electrical connectors and, particularly, to an electrical connector assembly which includes a header connector mounted on one side of a printed circuit board for mating, through the board, with a second connector on an opposite side of the board.

BACKGROUND OF THE INVENTION

Electrical connectors are mounted on printed circuit boards in a wide variety of applications. In some instances, an electrical connector simply is mounted to a surface of the printed circuit board, and the connector includes a plurality of terminals having tail portions for connection, as by soldering, to appropriate circuit traces on the board. In other applications, the electrical connector not only is mounted to a surface on one side of the circuit board, but the connector mates through the board with a second connector on an opposite side of the board. Typically, with such "through mating" connector assemblies, a "blind" mating situation occurs because a user or operator can neither see nor feel one of the connectors on a side of the circuit board opposite the location of the user. In such blind mating assemblies, one of the connectors typically has a guide post insertable into a guide hole in the other connector for guiding the connectors into mating alignment to facilitate the blind mating process.

Various problems occur in designing blind-mating, through-board connector assemblies as described above. One problem concerns the length of the guide posts which typically are on the blind mating connector. It is highly desirable to reduce the length of the guide posts as much as possible to prevent stubbing, breakage or the like. In addition, the guide posts often extend completely through the printed circuit board and beyond a rear side of the board-mounted connector on the opposite side of the board. Conserving space behind the connector for other electronic components is critical in some miniaturized situations and, again, reducing the length of the guide posts is not only desirable but quite important. The present invention is directed to solving these various problems.

SUMMARY OF THE INVENTION

An object, therefore, of the invention is to provide a new and improved connector assembly for mating through a printed circuit board.

In the exemplary embodiment of the invention, an electrical connector is provided for mounting on a printed circuit board which includes a mounting surface, an opposite mating surface, a locating hole and a terminal-receiving aperture. The connector includes a dielectric housing having a front board-mounting face for mounting against the mounting surface of the printed circuit board. At least one terminal-receiving passage in the housing has a front opening in the front board-mounting face of the housing, with the front opening alignable with the terminal-receiving aperture in the printed circuit board. An alignment boss projects from the front board-mounting face of the housing and is insertable into the locating hole in the printed circuit board. The alignment boss has a guide hole for receiving a guide post from a complementary mating connector at the mating surface of the printed circuit board. A conductive terminal is mounted on the housing and includes a tail portion outside the housing for connection to an appropriate circuit trace on the printed circuit board. The terminal includes a contact portion inside the terminal-receiving passage of the housing for engaging an appropriate terminal of the complementary mating connector.

According to one aspect of the invention, the alignment boss projects through the locating hole in the printed circuit board from the mounting surface of the board to a location generally flush with the mating surface of the board. The guide hole of the alignment boss has a flared mouth to facilitate inserting the guide post of the complementary mating connector into the guide hole.

According to another aspect of the invention, the dielectric housing is elongated and includes a pair of the alignment bosses near opposite ends of the elongated housing, the bosses being insertable into a pair of spaced locating holes in the printed circuit board. A row of the terminal-receiving passages are provided in the housing, the row extending in a direction between the pair of alignment bosses. A plurality of the conductive terminals are mounted on the housing, with the terminals having contact portions in the plurality of terminal-receiving passages. The row of passages are aligned with an elongated slot in the printed circuit board.

A further feature of the invention includes at least one flexible latch arm on the connector housing engageable in a latch opening in the printed circuit board.

The invention contemplates a connector assembly which includes the electrical connector described above in combination with a printed circuit board having the mounting surface, the opposite mating surface, the locating hole and the terminal-receiving aperture therethrough. The invention also contemplates an assembly which includes the electrical connector described above, in combination with the mating connector having one or more guide posts.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
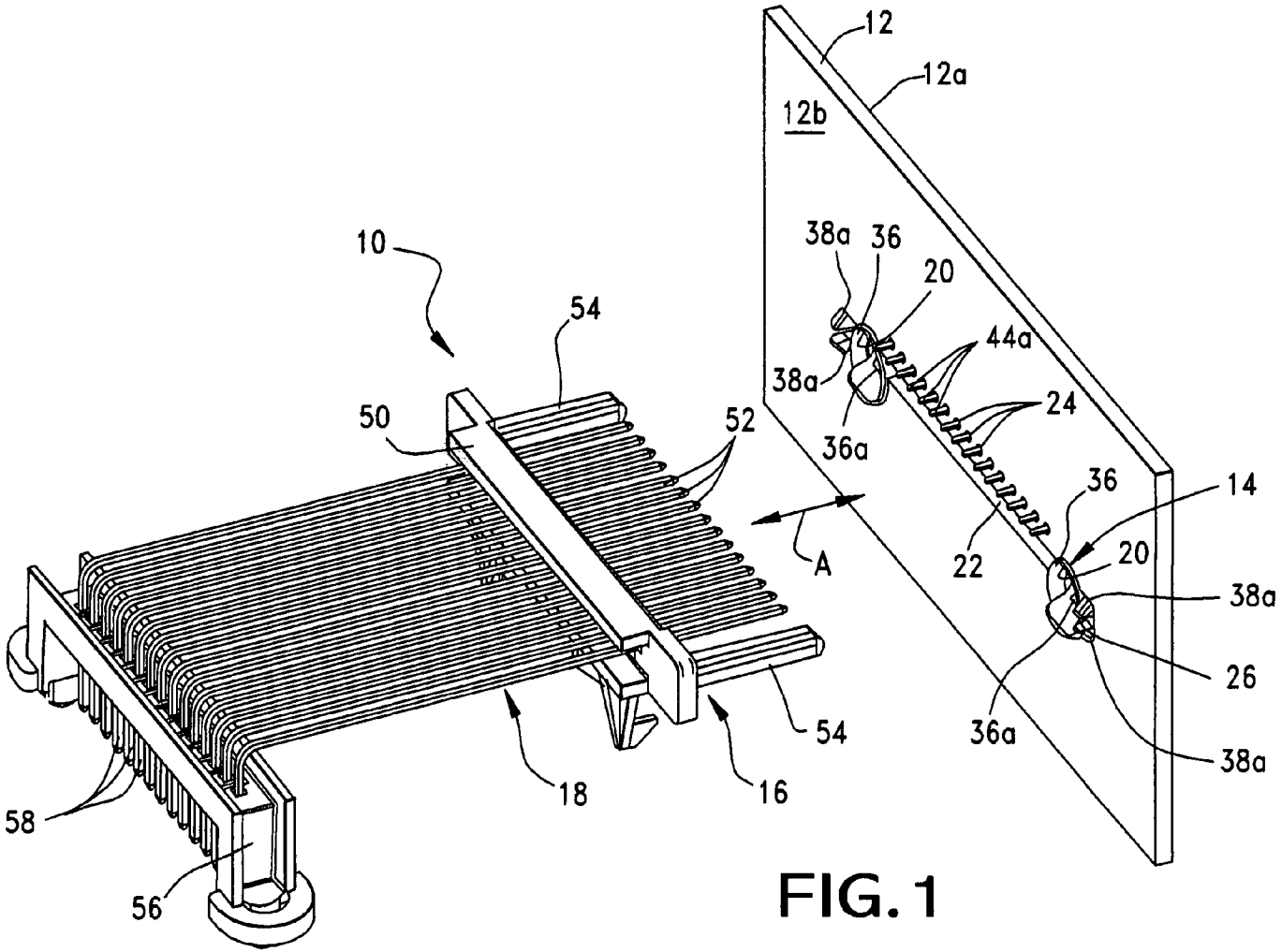
FIG. 1 is a perspective view of an electrical connector system embodying the concepts of the invention.

Referring to the drawings in greater detail, and first to FIG. 1, the invention is incorporated in an electrical connector system, generally designated 10, which includes a printed circuit board 12 which is the center of a blind-mating connector arrangement. Specifically, the printed circuit board has a mounting surface 12*a* and an opposite mating surface 12*b*. A header connector, generally designated 14 (also see FIG. 3), is mounted to mounting surface 12*a* of the circuit board, and a complementary mating connector, generally designated 16, is blind mated with header connector 14 in the direction of double-headed arrow "A" Mating connector 16 is part of an overall mating connector arrangement, generally designated 18.

Figure 2:
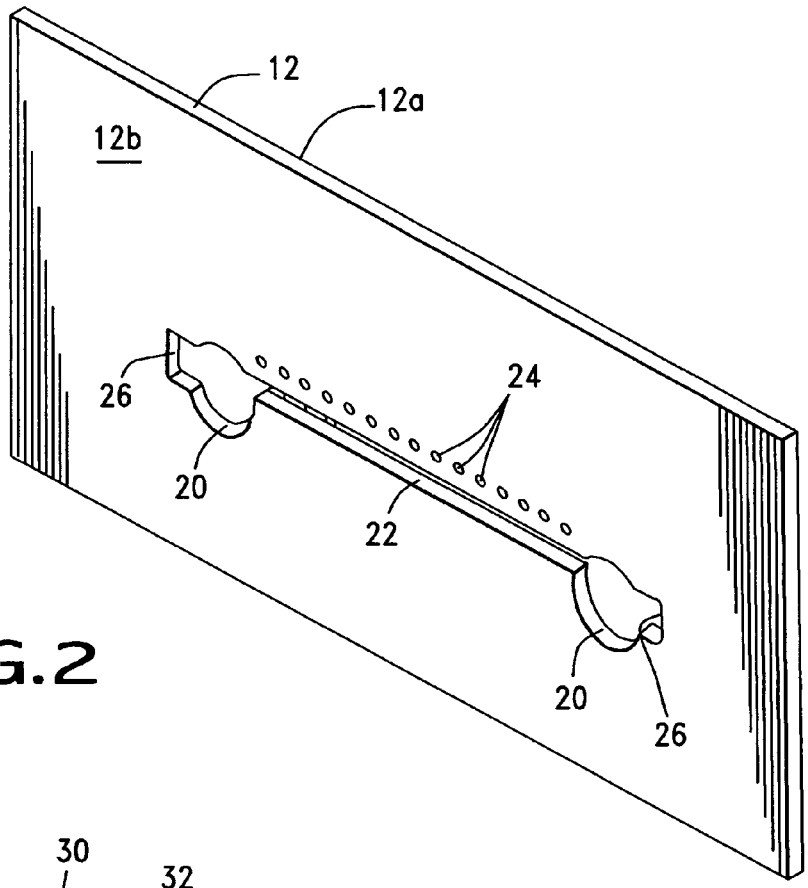
FIG. 2 is a perspective view of the printed circuit board shown in FIG. 1.

Referring to FIG. 2 in conjunction with FIG. 1, printed circuit board 12 includes a pair of spaced locating holes 20 and an elongated terminal-receiving slot 22 extending between the holes. A row of discrete tail-receiving holes 24 extend through the board, the row extending generally parallel to elongated slot 22. A cut-out or recess 26 is formed in the outside edge of each locating hole 20.

Figure 3:
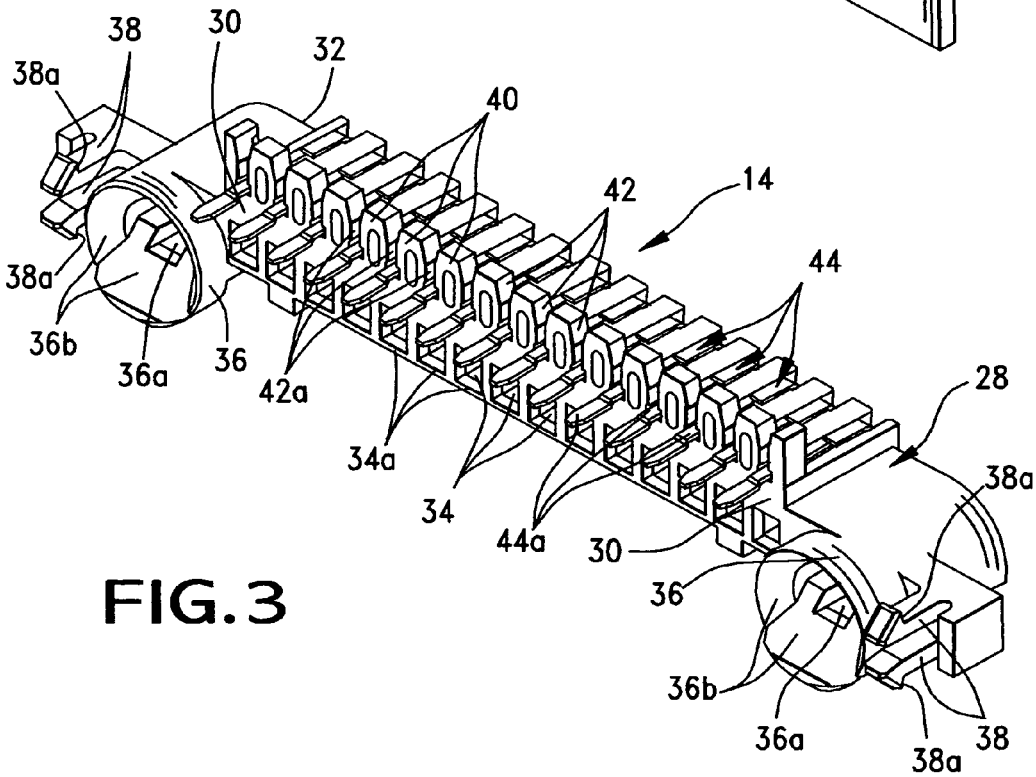
FIG. 3 is a perspective view of the header connector mounted to a mounting surface of the printed circuit board.

Referring to FIG. 3, header connector 14 includes a dielectric housing, generally designated 28, which is elongated and which may be a one-piece structure unitarily molded of plastic material or the like. The housing has a front board-mounting face 30 for mounting against the mounting surface 12*a* of printed circuit board 12. The housing also has a rear face 32. The housing has a row of terminal-receiving passages 34 having front openings 34*a* in a row in the front board-mounting face 30 of the housing. When header connector 14 is mounted to mounting surface 12*a* of the printed circuit board, openings 34*a* of terminal-receiving passages 34 are aligned with the elongated terminal-receiving slot 22 (FIG. 2) in the printed circuit board.

Still referring to FIG. 3, housing 28 of header connector 14 includes a pair of alignment bosses 36 which project from the front board-mounting face 30. The bosses are insertable into locating holes 20 (FIG. 2) of the printed circuit board. Each alignment boss 36 has a through guide hole 36*a* for receiving a guide post from mating connector 16, as described hereinafter. The guide hole has a flared mouth, as at 36*b*, to facilitate inserting the guide post into the guide hole. A pair of flexible latch arms 38, having latch hooks 38*a*, project from the board-mounting face of the housing outside each alignment boss 36. When header connector 14 is mounted to mounting surface 12*a* of the printed circuit board, latch arms 38*a* project through the cut-outs or recesses 26 (FIG. 2) in the printed circuit board. Finally, housing 28 of header connector 14 includes a plurality of upstanding retention teeth 40 which define a plurality of retention slots 42 therebetween, for purposes to be described hereinafter.

A plurality of conductive terminals, generally designated 44 (FIG. 3), are mounted on housing 28 of header connector 14. The terminals are generally U-shaped to define tail portions 44*a* and contact portions (not visible in the drawings) which are bent around rear face 32 of the housing and into passages 34 for engaging the terminals of mating connector 16 (FIG. 1). As can be seen clearly in FIG. 3, tail portions 44*a* of the terminals are located within retention slots 42 between retention teeth 40 of the housing. The retention slots have restricted mouths 42*a* past which the tail portions are snapped and securely retained within the slots.

Figure 4:
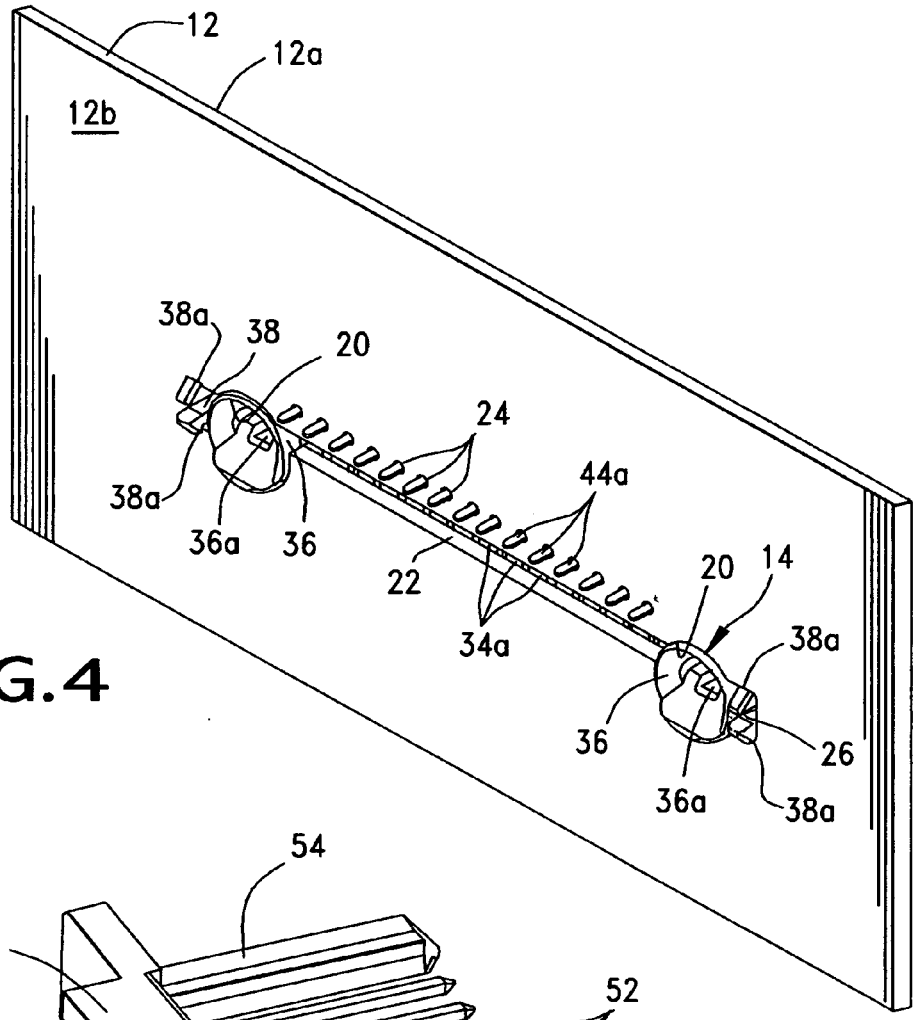
FIG. 4 is a perspective view of the header connector mounted to the printed circuit board, and looking at the mating surface of the board.
Figure 5:
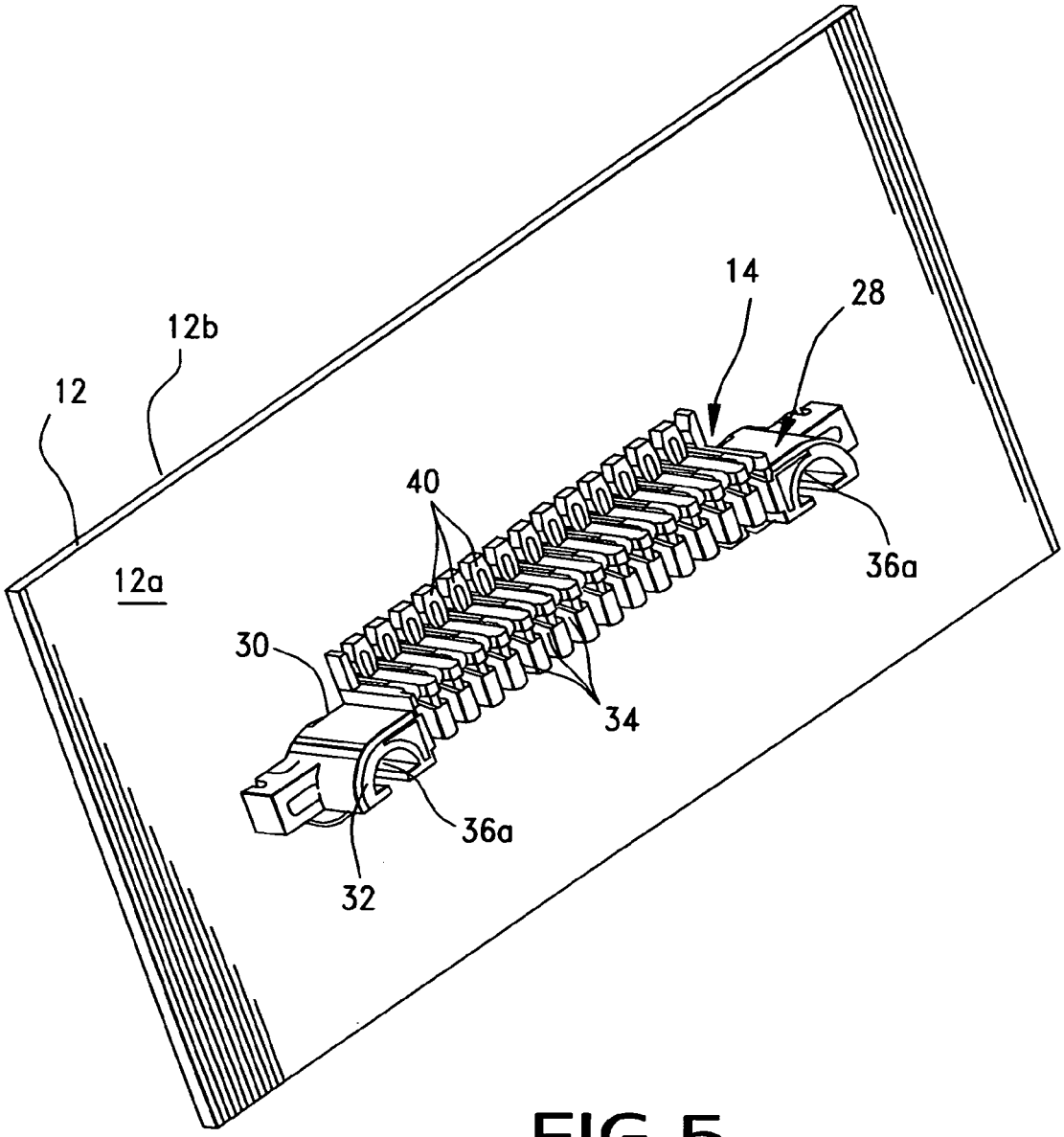
FIG. 5 is a view similar to that of FIG. 4, but looking at the mounting surface of the board and the rear face of the header connector.

FIGS. 4 and 5 show header connector 14 mounted to mounting surface 12*a* of printed circuit board 12. When securely mounted, the front board-mounting face 30 of connector housing 28 abuts mounting surface 12*a* of the board. Latch arms 38 project through recesses 26 in the board, and latch hooks 38*a* of the latch arms snap into latching engagement with the opposite mating surface 12*b* of the circuit board. Alignment bosses 36 project through locating holes 20 in the circuit board to a location generally flush with mating face 12*b* of the board. Front openings 34*a* of terminal-receiving passages 34 are aligned with elongated terminal-receiving slot 22 in the board. As seen in FIG. 5, retention teeth 40 abut against mounting surface 12*a* of the circuit board. As seen in FIG. 4, tail portions 44*a* of the terminals project through holes 24 in the circuit board, and the tails are connected, as by soldering, to appropriate circuit traces (not shown) on the board and/or in the holes.

Figure 6:
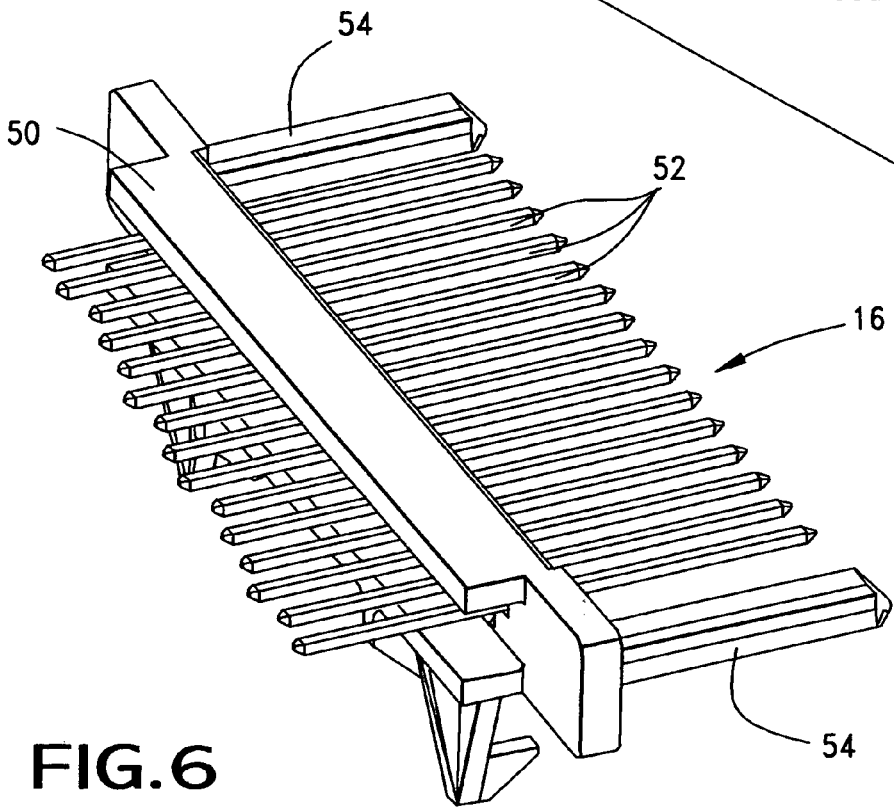
FIG. 6 is a perspective view of the second or mating connector shown in FIG. 1 which mates with the header connector of FIG. 3.

FIG. 6 shows mating connector 16 of the overall mating connector arrangement 18 shown in FIG. 1. The mating connector can take a variety of configurations. However, the connector shown includes a dielectric housing 50 having a row of terminal pins 52 projecting forwardly thereof. A pair of guide posts 54 are located at opposite ends of the row of terminal pins and project generally parallel thereto. As seen in FIG. 1, terminal pins 52 project rearwardly in the overall mating connector arrangement 18 to a second housing or alignment body 56 which aligns a plurality of tail portions 58 of the terminal pins which may be connected, as by soldering, to circuit traces on another printed circuit board (not shown).

When mating connector 16 is mated with header connector 14 as represented by double-headed arrow "A" (FIG. 1), terminal pins 52 are inserted through the elongated terminal-receiving slot 22 of printed circuit board 12, and the terminal pins are inserted through openings 34*a* (FIG. 3) and into terminal-receiving passages 34 of header connector 14, whereupon the terminal pins engage the contact portions of terminals 44 within the passages. In addition, guide posts 54 of mating connector 16 are inserted into the guide holes 36*a* of alignment bosses 36 of the header connector which is mounted at the opposite side of the circuit board.

It should be understood that guide posts 54 must be inserted into the guide holes of the header connector before terminal pins 52 are inserted into passages 34 of the header connector, so that the posts precisely align the terminal pins with the passages to prevent the terminal pins from stubbing on the housing of the header connector. In the prior art, this means that guide posts 54 should be longer than the terminal pins so that the guide posts "mate" before the terminal pins "mate". However, it should be noted in FIG. 1 that guide posts 54 are substantially the same length as terminal pins 52. By extending alignment bosses 36 through the thickness of printed circuit board 12 within locating holes 20, according to the invention, guide posts 54 can enter guide holes 36*a* before terminal pins 52 enter passages 34. In other words, the arrangement or system of the present invention achieves the results of the prior art while shortening the length of guide posts 54.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting on a printed circuit board which includes a mounting surface, an opposite mating surface, a locating hole and a terminal-receiving aperture, comprising:

a dielectric housing having a front board-mounting face for mounting against the mounting surface of the printed circuit board, at least one terminal-receiving passage having a front opening in the front board-mounting face and alignable with the terminal-receiving aperture in the printed circuit board, and an alignment boss projecting from the front board-mounting face and insertable into and through the locating hole in the printed circuit board from the mounting surface of the board to a location at least generally flush with the mating surface of the board, the alignment boss having a guide hole for receiving a guide post from a complementary mating connector at the mating surface of the printed circuit board and at least one flexible latch arm engagable in a latch opening in and insertable in a direction perpendicular to the printed circuit board; and a conductive terminal mounted on the housing and including a tail portion outside the housing for connection to an appropriate circuit trace on the printed circuit board, and a contact portion inside the terminal-receiving passage of the housing for engaging an appropriate terminal of the complementary mating connector.

2. The electrical connector of claim 1 wherein the guide hole of the alignment boss has a flared mouth to facilitate inserting the guide post of the complementary mating connector into the guide hole.

3. The electrical connector of claim 1, wherein said dielectric housing is elongated and including a pair of said alignment bosses near opposite ends of the elongated housing, the bosses being insertable into a pair of spaced locating holes in the printed circuit board.

4. The electrical connector of claim 3, including a row of said terminal-receiving passages in the housing, the row extending in a direction between the pair of alignment bosses, a plurality of said conductive terminals mounted on the housing, the terminals having contact portions in the plurality of terminal-receiving passages, and the row of passages being aligned with an elongated slot in the printed circuit board.

5. An electrical connector assembly for mounting on a printed circuit board which includes a mounting surface, an opposite mating surface, a locating hole and a terminal-receiving aperture, comprising:

a header connector including a dielectric housing having a front board-mounting face for mounting against the mounting surface of the printed circuit board, at least one terminal-receiving passage having a front opening in the front board-mounting face and alignable with the terminal-receiving aperture in the printed circuit board, and an alignment boss projecting from the front board-mounting face and insertable into and through the locating hole in the printed circuit board from the mounting surface of the board to a location at least generally flush with the mating surface of the board, the alignment boss having a guide hole, and a conductive terminal mounted on the housing and including a tail portion outside the housing for connection to an appropriate circuit trace on the printed circuit board, and a contact portion inside the terminal-receiving passage of the housing for engaging an appropriate terminal of a mating connector and at least one flexible latch arm on the housing engageable in a latch opening in and insertable in a direction perpendicular to the printed circuit board; and said mating connector at the mating surface of the printed circuit board, said mating connector including a terminal for engaging the conductive terminal of the header connector and a guide post for insertion into the guide hole in the alignment boss from the mating surface of the printed circuit board.

6. The electrical connector assembly of claim 5 wherein the guide hole of the alignment boss has a flared mouth to facilitate inserting the guide post of the mating connector into the guide hole.

7. The electrical connector assembly of claim 5, wherein said dielectric housing is elongated and including a pair of said alignment bosses near opposite ends of the elongated housing, the bosses being insertable into a pair of spaced locating holes in the printed circuit board.

8. The electrical connector assembly of claim 7, including a row of said terminal-receiving passages in the housing, the row extending in a direction between the pair of alignment bosses, a plurality of said conductive terminals mounted on the housing, the terminals having contact portions in the plurality of terminal-receiving passages, and the row of passages being aligned with an elongated slot in the printed circuit board.

9. The electrical connector of claim 8 wherein said mating connector includes a row of terminals insertable through the elongated slot in the printed circuit board and into the row of terminal-receiving passages in the housing of the header connector for engagement with the contact portions of the plurality of conductive terminals in the terminal-receiving passages of the housing of the header connector.

* * * * *